US010641265B2

(12) United States Patent
Kimball et al.

(10) Patent No.: US 10,641,265 B2
(45) Date of Patent: May 5, 2020

(54) WATER PUMP FOR MARINE ENGINE HAVING TOOL FOR REPLACING IMPELLER

(71) Applicant: Indmar Products Company Inc., Millington, TN (US)

(72) Inventors: Kevin J. Kimball, Mount Dora, FL (US); Jason C. Stimmel, Eads, TN (US)

(73) Assignee: Indmar Products Company Inc., Millington, TN (US)

( * ) Notice: Subject to any disclaimer, the term of this patent is extended or adjusted under 35 U.S.C. 154(b) by 299 days.

(21) Appl. No.: 15/911,656

(22) Filed: Mar. 5, 2018

(65) Prior Publication Data

US 2019/0271308 A1 Sep. 5, 2019

(51) Int. Cl.

| | |
|---|---|
| ***F01C 5/00*** | (2006.01) |
| ***F03C 2/00*** | (2006.01) |
| ***F03C 4/00*** | (2006.01) |
| ***F04C 5/00*** | (2006.01) |
| ***F04C 2/32*** | (2006.01) |
| ***F04C 15/00*** | (2006.01) |
| *B63H 20/00* | (2006.01) |

(52) U.S. Cl.

CPC ..... *F04C 2/321* (2013.01); *F04C 15/0076* (2013.01); *B63H 2020/008* (2013.01); *F04C 2210/1094* (2013.01); *F04C 2230/604* (2013.01); *F04C 2230/70* (2013.01); *F04C 2230/85* (2013.01); *F04C 2240/20* (2013.01); *F04C 2240/805* (2013.01)

(58) Field of Classification Search

CPC .... F04C 2/321; F04C 2/44; F04C 5/00; F04C 15/0076; F04C 2210/1094; F04C 2230/00; F04C 2230/604; F04C 2230/70; F04C 2230/85; F04C 2240/20; F04C 2240/805; B63H 2020/008; F01C 21/10

USPC ..... 418/153–156; 415/140, 141; 416/146 R, 416/240, 244 R; 29/264, 257, 266

See application file for complete search history.

(56) References Cited

U.S. PATENT DOCUMENTS

| | | | | |
|---|---|---|---|---|
| 5,152,044 | A * | 10/1992 | Bales | B25B 27/04 29/257 |
| 6,394,753 | B1 | 5/2002 | Maki et al. | |
| 8,312,607 | B2 | 11/2012 | Pecherzewski | |
| 2001/0004447 | A1* | 6/2001 | Barnes | F04C 5/00 418/153 |

(Continued)

FOREIGN PATENT DOCUMENTS

| | | | | |
|---|---|---|---|---|
| GB | 870662 | A * | 6/1961 | F04C 5/00 |

*Primary Examiner* — Theresa Trieu

(74) *Attorney, Agent, or Firm* — Wood, Herron & Evans, LLP

(57) ABSTRACT

A water pump for a marine engine includes a cap covering an internal cavity of the pump's housing when the pump is operating. The cap functions as a tool to remove a damaged or worn impeller from inside the internal cavity. A threaded hub of the cap engages internal threads of the impeller to assist a user in removing the impeller for replacement. A cap lock ring threaded onto the pump housing retains the cap over the internal cavity. A rotatable drive shaft has splines which mate with a splined portion of the impeller to rotate the impeller. The cap lock ring is disengaged from the housing and the cap removed to enable a person to use the threaded hub of the cap to remove the impeller.

20 Claims, 11 Drawing Sheets

(56) References Cited

U.S. PATENT DOCUMENTS

2009/0180879 A1* 7/2009 Bear ..... F04D 29/382
416/240

* cited by examiner

WATER PUMP FOR MARINE ENGINE HAVING TOOL FOR REPLACING IMPELLER

TECHNICAL FIELD

The present invention relates generally to water pumps for marine engines, and more particularly, to a water pump for a marine engine having a tool for replacing the impeller of the water pump.

BACKGROUND

Water pumps for marine engines generally include a flexible impeller mounted on a shaft in a pump housing for rotation therein. The flexible impeller must be removed annually when winterizing the marine engine to prevent the rubber from being damaged due to freezing and thawing. Because a marine engine is commonly operated in salt water, the impeller may become encrusted with silt and salt. It is common to have to replace the pump impeller after every 100 hours of operation.

In conventional marine engines, the water pump is mounted in an area dark and difficult to access. To change the flexible impeller, a cover plate must be removed. Known cover plates are screwed into the pump housing. Therefore, one must use a screw driver to remove the screws holding on a cover plate before changing the flexible impeller. Due to the location of the water pump, fitting a screw driver into a tight, dark area is challenging. Once the cover plate is removed, the flexible impeller must be removed from inside the pump housing.

One method of removing the flexible impeller is to use two sets of pliers. Two impeller blades are gripped on either side using the pliers. Alternatively, a screw driver may be used to pry an impeller from inside the pump housing.

For large impellers or impellers stuck on a shaft inside the pump housing, the methods described above may not be adequate. In such situations, the user may have to remove the water pump from the marine engine and work on removing the impeller remotely which may not be practical such as when a marine engine is being used at sea. Alternatively, a separate tool such as one disclosed in U.S. Pat. No. 6,394,753 or 8,312,607 may be used. However, it is unlikely such a separate tool is carried aboard the vessel driven by the marine engine with a failed water pump.

Accordingly, there is a need for a water pump for use in a marine engine with a tool for removing an impeller from inside the water pump.

SUMMARY

According to an exemplary embodiment of the invention, a water pump for a marine exhaust system includes a housing having an internal cavity having an open end. The housing has external threads surrounding a portion of the internal cavity. The water pump further comprises an impeller inside the internal cavity of the housing. The impeller has a plurality of flexible blades extending radially outwardly from a central portion and a bore extending through the central portion of the impeller. The bore has a splined portion and a threaded portion.

The water pump further comprises a drive assembly having a drive flange adapted to be rotated by the marine engine and a drive shaft. The drive shaft has splines and extends inside the internal cavity of the housing. The splined portion of the impeller bore mates with the splines of the drive shaft such that rotation of the drive shaft rotates the impeller.

The water pump further comprises a cap lock ring having internal threads along a continuous sidewall and a flange defining a central opening. The internal threads of the cap lock ring engage the external threads on the open end of the internal cavity of the housing to secure the cap lock ring to the housing. The water pump further comprises a cap having a threaded hub adapted to engage the threaded portion of the bore of the impeller to assist in removing the impeller from the housing. The cap is sized to fit inside the cap lock ring and close the open end of the internal cavity of the housing. The threaded hub extends through the central opening of the cap lock ring when the water pump is assembled. The cap lock ring may be disengaged from the housing and the cap removed to expose the impeller and enable a person to use the threaded hub of the cap to remove the impeller from inside the internal cavity of the housing.

The water pump further comprises a nipple assembly secured to the housing, the nipple assembly comprising first and second nipples, the first nipple being adapted to couple to an inlet hose and the second nipple being adapted to couple to an outlet hose.

According to another aspect of the invention, a water pump for a marine engine comprises a housing having an internal cavity and external threads on an open end of the internal cavity. An impeller inside the internal cavity of the housing has a plurality of flexible blades extending radially outwardly from a central portion and a bore extending through the central portion of the impeller. The impeller bore has a splined portion and a threaded portion.

The water pump further comprises a rotatable drive assembly comprising a drive flange and a drive shaft having splines. The drive shaft extends inside the internal cavity of the housing. The splined portion of the bore of the impeller mates with the splines of the drive shaft such that rotation of the drive shaft rotates the impeller. A cap lock ring having internal threads adapted to engage the external threads on the open end of the internal cavity of the housing is used to close the internal cavity of the housing. A cap having a threaded hub is adapted to engage the threaded portion of the bore of the impeller to remove the impeller from inside the internal cavity of the housing. The cap is sized to fit inside the cap lock ring and cover the open end of the internal cavity, the threaded hub extending through a central opening of the cap lock ring. The cap lock ring and cap may be removed to expose the impeller and the threaded hub of the cap used to engage the threaded portion of the impeller bore to remove the impeller.

According to another aspect of the invention, a water pump for a marine engine comprises an injection molded plastic housing having an internal cavity having an open end. The housing has external threads around the open end of the internal cavity. An impeller inside the internal cavity of the housing has a plurality of flexible blades extending radially outwardly from a central portion. A bore extends through the central portion of the impeller. The bore of the impeller has a splined portion for rotating the impeller and a threaded portion for removing the impeller.

The water pump further comprises a drive assembly for rotating the impeller. The drive assembly comprises a drive flange and a drive shaft having splines. The drive shaft extends into the internal cavity of the housing. The splined portion of the bore of the impeller mates with the splines of the drive shaft such that rotation of the drive shaft rotates the impeller. An injection molded plastic cap lock ring having a sidewall, a flange defining a central opening and tabs to facilitate rotating the cap lock ring is used to secure the cap over the open end of the internal cavity of the housing. The sidewall of the injection molded plastic cap has internal threads adapted to engage the external threads around the open end of the internal cavity of the housing. A cap is sized to fit inside the cap lock ring and cover the open end of the internal cavity. The cap has a threaded hub adapted to engage the threaded portion of the bore of the impeller to remove the impeller. The threaded hub of the cap extends through the central opening of the cap lock ring and away from the drive assembly during operation of the pump. The cap lock ring and cap may be removed without tools to expose the impeller and the threaded hub of the cap screwed into the threaded portion of the bore of the impeller for use removing the impeller.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, explain the embodiments of the invention.

DETAILED DESCRIPTION

Figure 1:
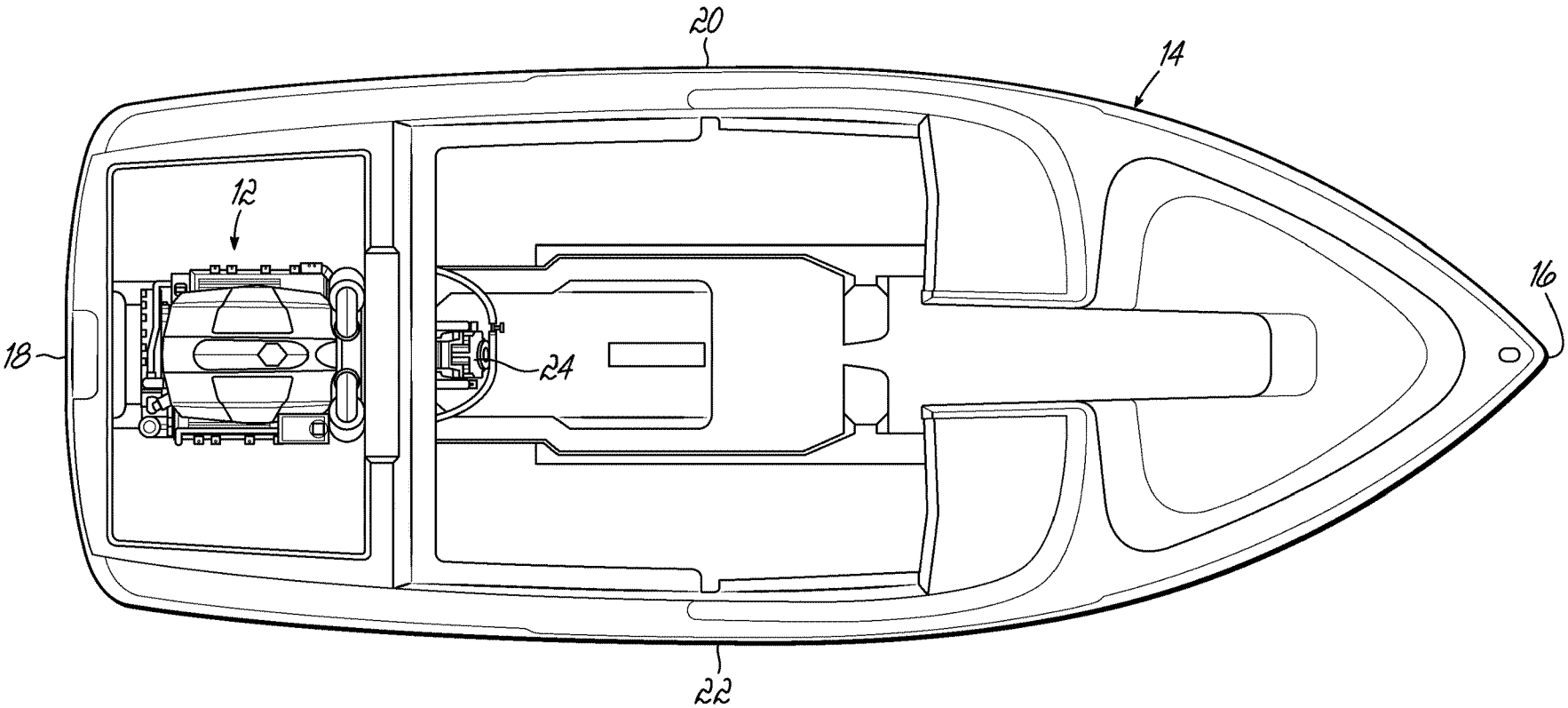
FIG. 1 is a top view of a motorboat including an inboard engine.
Figure 2A:
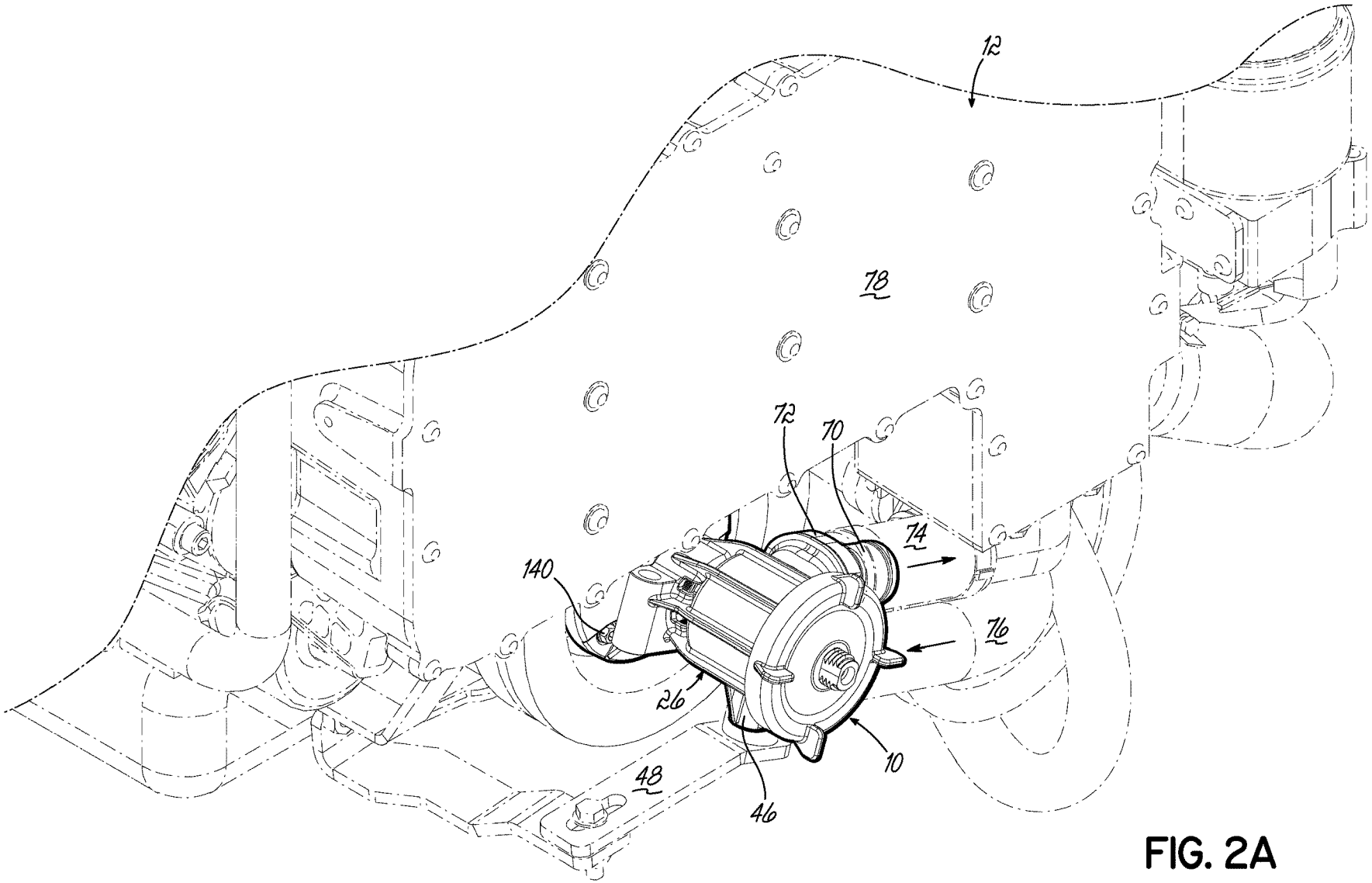
FIG. 2A is a perspective view of a portion of a marine engine showing the water pump mounted to the marine engine.

Referring to FIG. 2A, a water pump 10, according to an exemplary embodiment of the invention, is shown mounted to a marine engine 12 within a motorboat 14. The motorboat 14 includes a bow 16, a stern 18, a port side 20, and a starboard side 22. The engine 12 is shown mounted in an "inboard" configuration and is coupled to a V-drive transmission 24 that drives a propeller shaft and propeller (not shown) to rotate, which propels the motorboat 24 through the water.

Figure 2B:
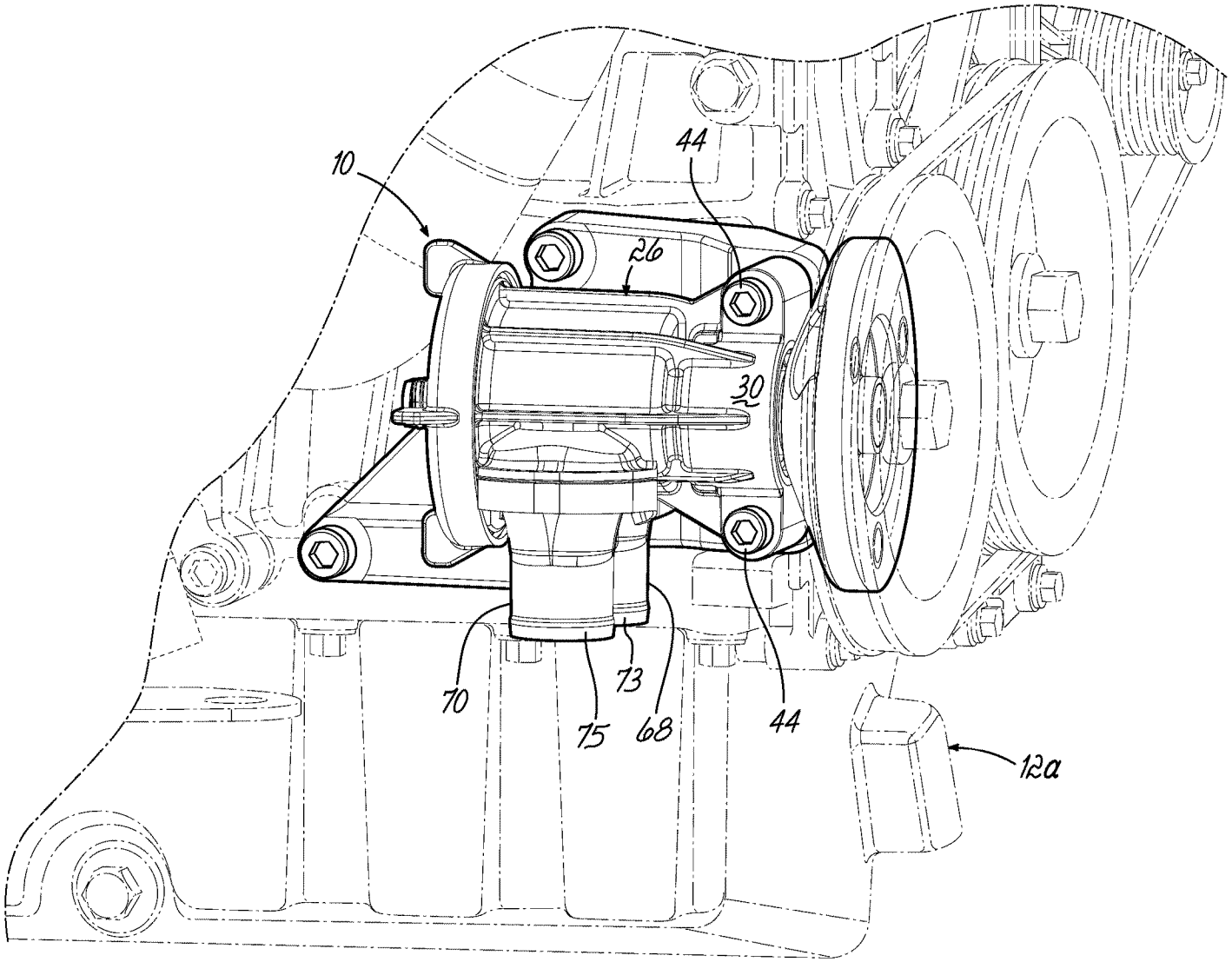
FIG. 2B is a perspective view of a portion of a different marine engine showing the water pump mounted to the marine engine.

Referring to FIG. 2B, the water pump 10 is shown mounted to a different engine 12*a*, the water pump being driven by a belt. The marine engines shown herein are not intended to be limiting. The water pump 10 of the present invention may be used in any marine engine.

Figure 3:
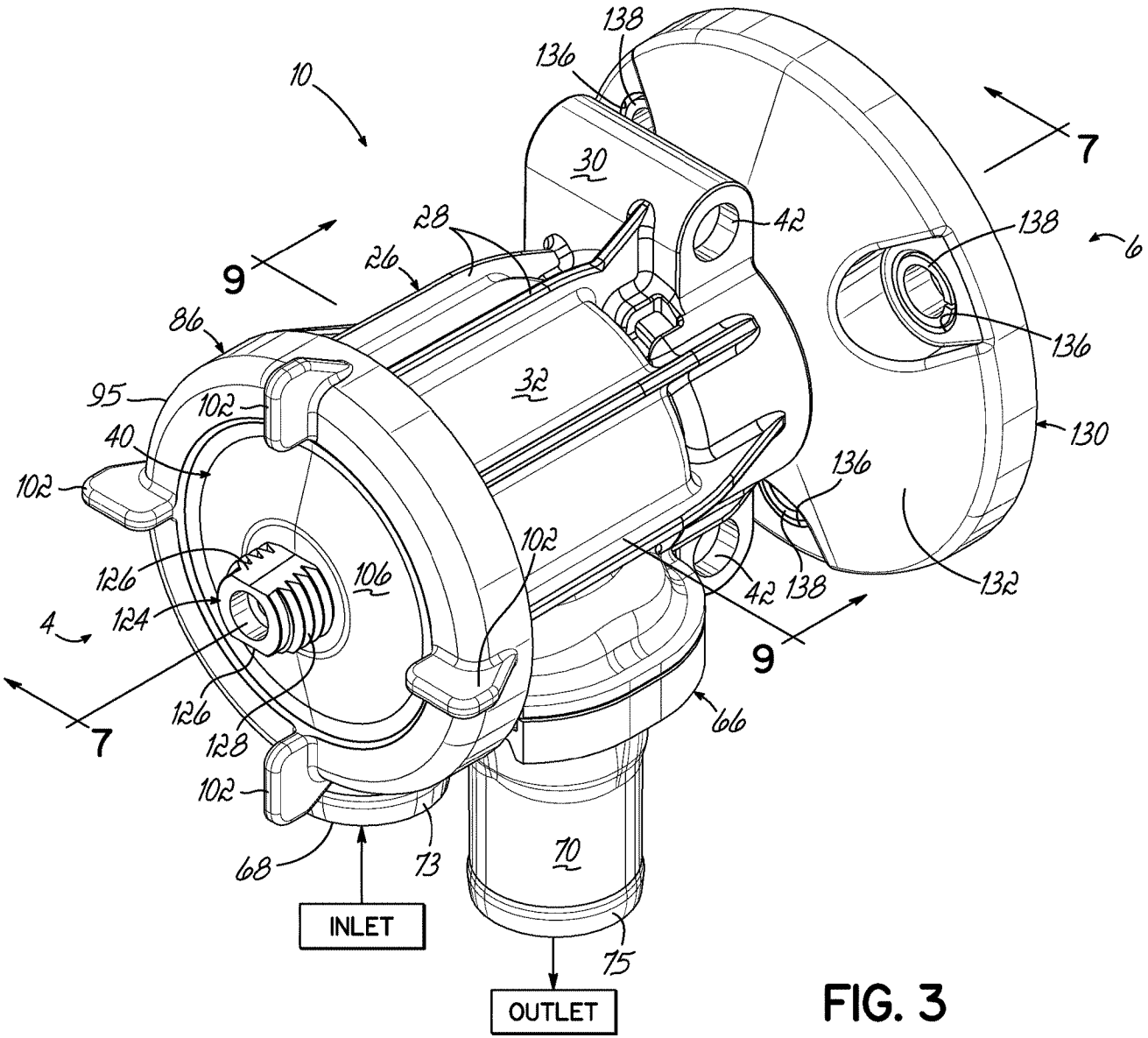
FIG. 3 is a perspective view showing the fully assembled water pump of the present invention.

Referring to FIG. 3, for purposes of this document, water pump 10 has a front 4 and a rear 6. FIG. 3 illustrates the water pump 10 in a fully assembled position unattached to any marine engine. When the water pump 10 is operating and water is moving through the water pump, it is in its fully assembled position shown in FIG. 3.

Figure 4:
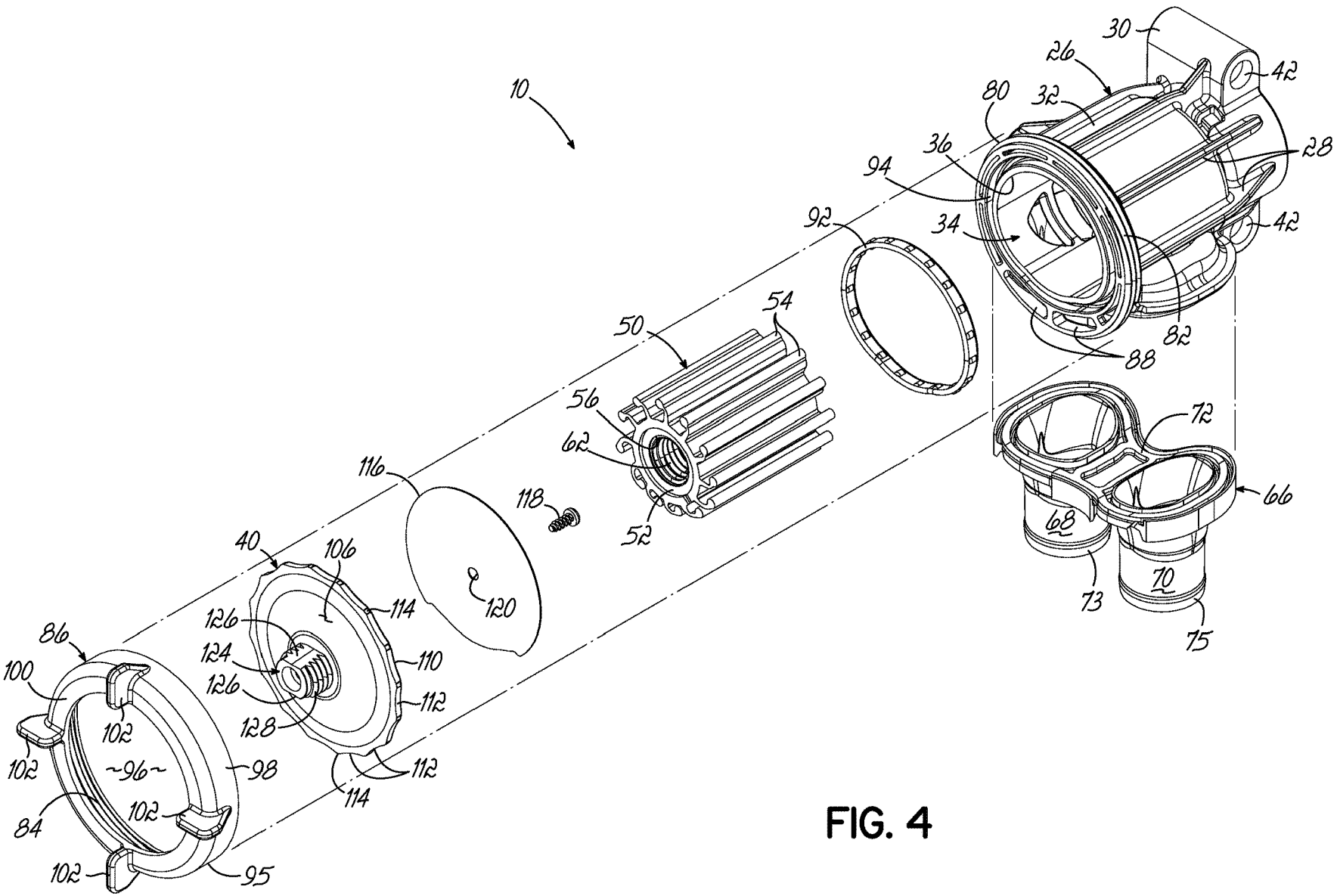
FIG. 4 is a perspective disassembled view of a portion of the water pump without the drive assembly.
Figure 5:
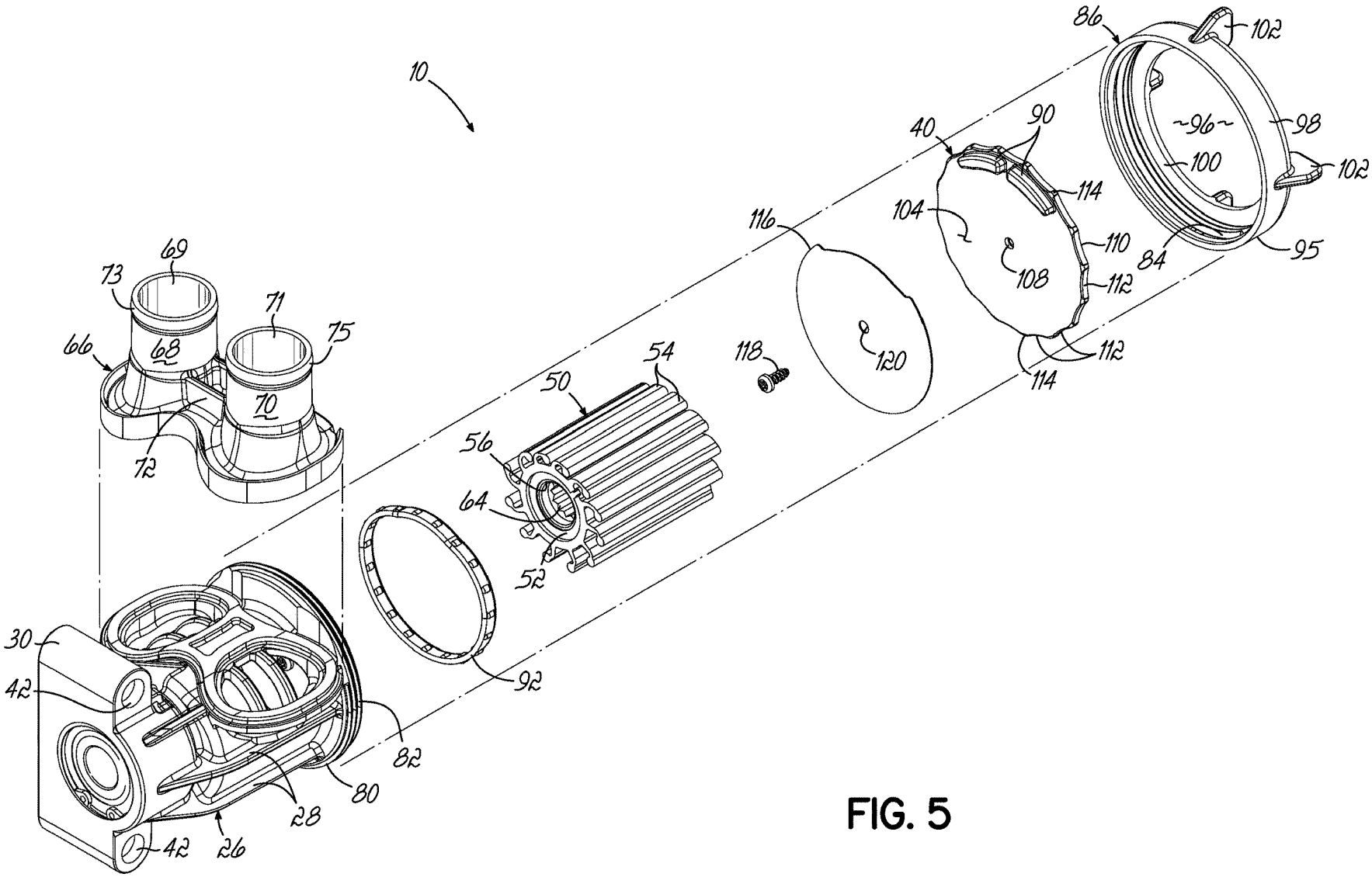
FIG. 5 is a perspective disassembled view of a portion of the water pump without the drive assembly.

As best seen in FIGS. 4 and 5, the water pump 10 has a housing 26 which is preferably a unitary member made of injection molded plastic, but may be made of any desired material. One advantage of a plastic housing is that it is corrosion proof. The housing 26 has a flange portion 80 located at the front of the housing 26, a mounting portion 30 located at the rear of the housing and a generally cylindrical cavity portion 32 between the flange portion 80 and the mounting portion 30. The housing 26 has a plurality of spaced external ribs 28 extending along the generally cylindrical cavity portion 32 and terminating in the mounting portion 30 of the housing 26. The housing 26 has an internal cavity 34 having an open end 36 which may be covered with a cap 40, as discussed below.

Figure 6:
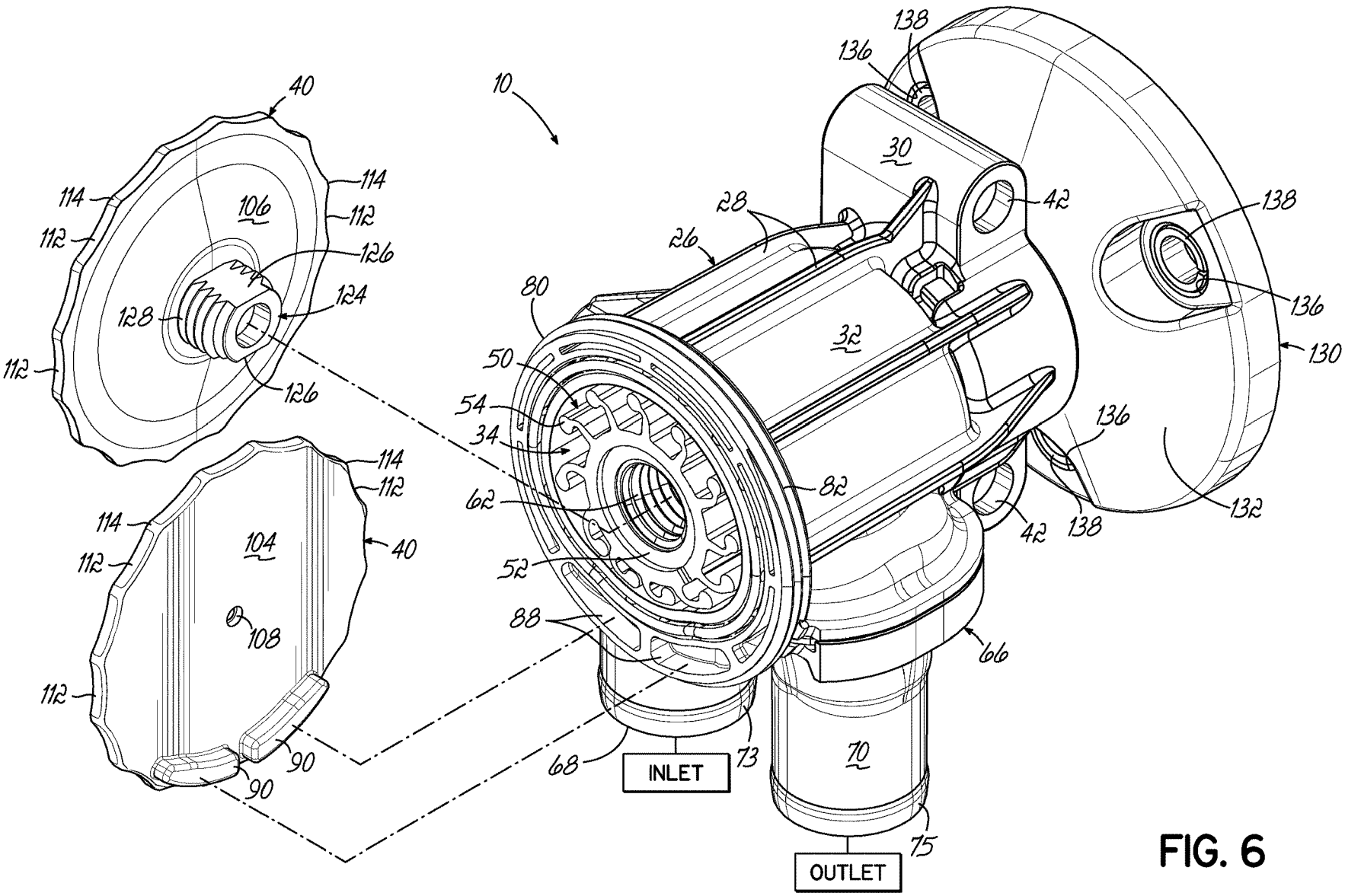
FIG. 6 is a perspective disassembled view of a portion of the water pump showing both sides of the cap.

As best shown in FIG. 5, the flange portion 80 of the housing 26 has external threads 82 for engaging internal threads 84 of a cap lock ring 86 to secure the cap lock ring 86 to the housing 26 with the cap 40 therebetween covering the open end 36 of the internal cavity 34. As best shown in FIG. 6, the flange portion 80 of the housing 26 further comprises two recesses 88 sized to receive and retain locators 90 of the cap 40.

Figure 7:
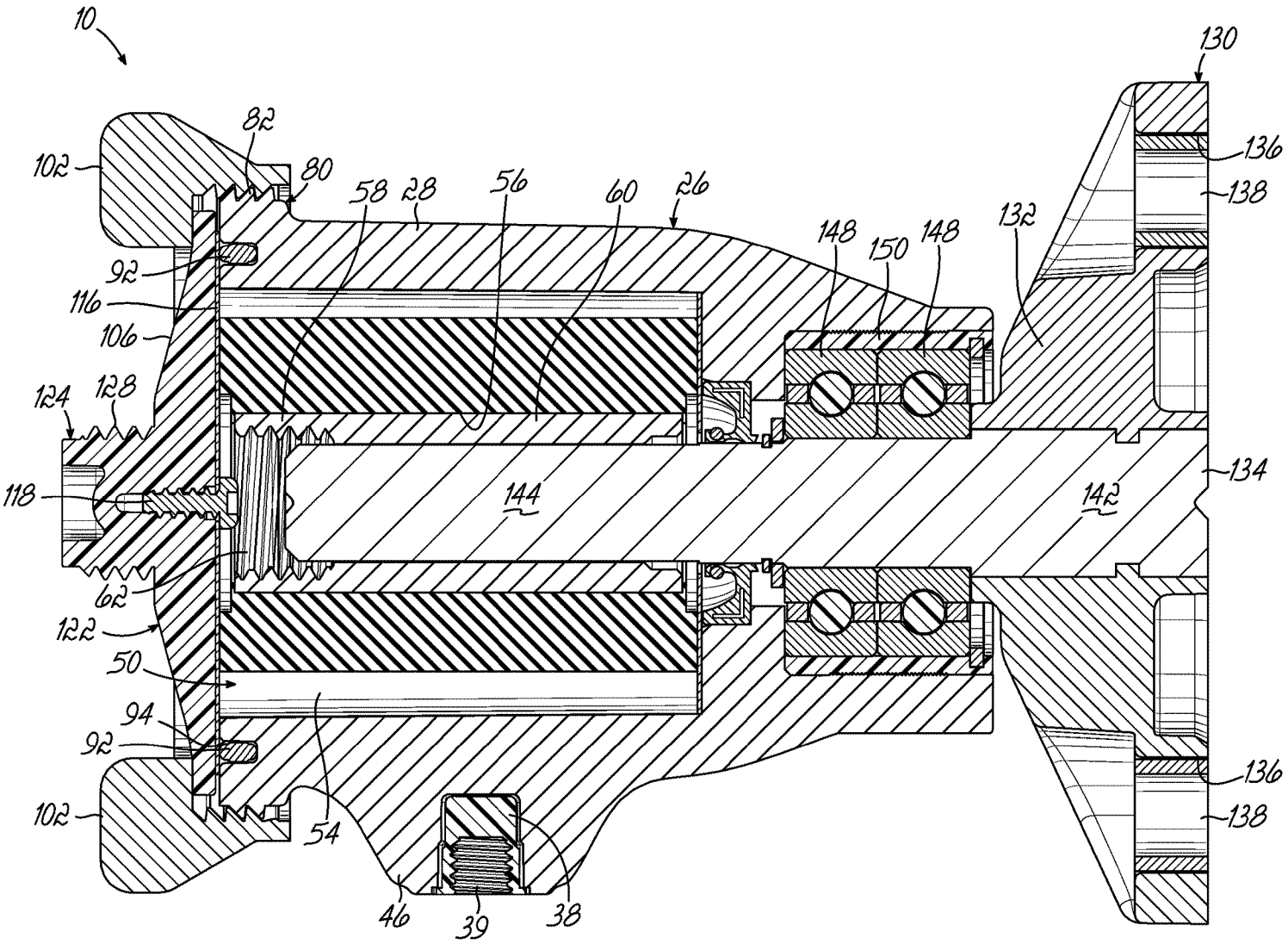
FIG. 7 is a cross-sectional view of the water pump taken along the line 7-7 of FIG. 3 showing the bearings of the water pump.

The mounting portion 30 of housing 26 comprises two bosses 42 which are used to mount the water pump 10 to a marine engine such as marine engine 12*a* with fasteners 44, as shown in FIG. 2B. As shown in FIG. 2A, the cavity portion 32 of housing 26 of water pump 10 further comprises a stabilizer portion 46 to which a stabilizing bracket 48 is attached. As best shown in FIG. 7, an internally threaded boss 38 having internal threads 39 is mounted in the stabilizer portion 46 of the housing 26. A threaded fastener (not shown) is used to secure one end of stabilizing bracket 48 to the stabilizer portion 46 of the housing 26 using the internally threaded boss 38 to reduce and hopefully prevent movement of the water pump during operation.

As best seen in FIGS. 4 and 5, the water pump 10 further comprises an impeller 50. The impeller 50 is sized to rotate inside the internal cavity 34 of housing 26. The impeller 50 has a central portion 52 and a plurality of flexible blades 54 extending radially outward from the central portion 52. Although the flexible blades 54 are illustrated having a particular configuration, the drawings are not intended to limit the configuration or shape of the flexible blades.

A bore 56 extends through the impeller 50 and has a threaded portion 58 at one end and a splined portion 60. The threaded portion 58 of bore 56, best shown in FIGS. 4 and 7, has internal threads 62 and is located at the front of the impeller 50. The splined portion 60 of bore 56, best shown in FIGS. 5 and 9, has internal ribs 64.

As best seen in FIGS. 4 and 5, the water pump 10 further comprises a nipple assembly 66 which is removably attached to the housing 26 via ultrasonic welding. However, the nipple assembly 66 may be removably attached to the housing 26 via any known method including fasteners. The nipple assembly 66 comprises a first nipple 68 having a hollow interior 69 and a second nipple 70 having a hollow interior 71 joined by a bridge 72. As best shown in FIG. 2A, an inlet hose 76 fits over the first nipple 68 and carries water from a raw water source (not shown) such as a lake to the water pump 10. As best shown in FIG. 2A, an outlet hose 74 fits over the second nipple 70 and carries water from the water pump 10 to a heat exchanger 78. The first nipple 68 has a flared portion 73 to assist securing the inlet hose 76 over the first nipple 68. The second nipple 70 has a flared portion 75 to assist securing the outlet hose 74 over the second nipple 70. See FIG. 2A.

As best seen in FIGS. 4 and 5, the water pump 10 further comprises a seal 92 which fits inside a groove 94 in the flange portion 80 of housing 26. The seal 92 functions to prevent water leaks from the housing 26 when the cap 40 is tightened against the flange portion 80 of housing 26 by cap lock ring 86.

As best seen in FIGS. 4 and 5, the cap lock ring 86 of the water pump 10 is a unitary injection molded plastic piece having a ring-shaped body 95 defining a central opening 96 therein. The ring-shaped body 95 comprises a continuous sidewall portion 98 and an inwardly directed, continuous flange portion 100 which defines the size of the central opening 96. As best shown in FIG. 3, the continuous sidewall portion 98 extends downwardly from the continuous flange portion 100 so they are generally orthogonal to each other. Four spaced tabs 102 are integral with the ring-shaped body 95 and extend upwardly from the continuous flange portion 100 to facilitate rotating the cap lock ring 86. Although four tabs 102 are illustrated, any number of tabs of any desired shape may be used to rotate the cap lock ring 86.

The cap 40 is generally circular and sized to fit inside the cap lock ring 86 and cover the open end 36 of the internal cavity 34 of the housing 26, as illustrated in FIG. 6. The cap 40 has a generally planar inner surface 104, a curved outer surface 106, a threaded hole 108 and a serrated perimeter 110 to facilitate grasping and rotating the cap 40. The serrated perimeter 110 comprises a plurality of curved serrations 112, between which are located points 114. The cap 40 is preferably made of plastic, but may be made of any desired material.

As best illustrated in FIG. 6, cap 40 also has a threaded hub 124 projecting outwardly from the curved outer surface 106 of the cap 40. The threaded hub 124 has two opposed flats 126 between which are external threads 128 adapted to engage the internal threads 62 of the threaded portion 58 of bore 56 of impeller 50 when the cap 40 is used as a tool to help remove the impeller 50 from inside the internal cavity 34 of the housing 26.

As shown in FIG. 6, when the cap 40 is covering the open end 36 of the internal cavity 34 of the housing 26, the locators 90 are located inside the recesses 88 of the housing 26. As best seen in FIGS. 4 and 5, a generally planar wear plate 116 is secured to the cap 40 with threaded fastener 118 to form a cap assembly 122. The wear plate 116 is preferably made of stainless steel for wear resistance since the spinning impeller 50 may rub against the wear plate 116, but may be made of any desired material. The wear plate 116 abuts the inner surface 106 of the cap 40. The threaded fastener 118 extends through an opening 120 in the wear plate 116 and into the threaded hole 108 of cap 40. The interaction between the locators 90 of the cap assembly 122 and the recesses 88 of the housing 26 ensure the cap assembly 122 is positioned properly and abutting the seal 92. The wear plate 116 of cap assembly 122 prevents the rubber of the impeller 50 from rubbing against the plastic of cap 40.

Figure 10:
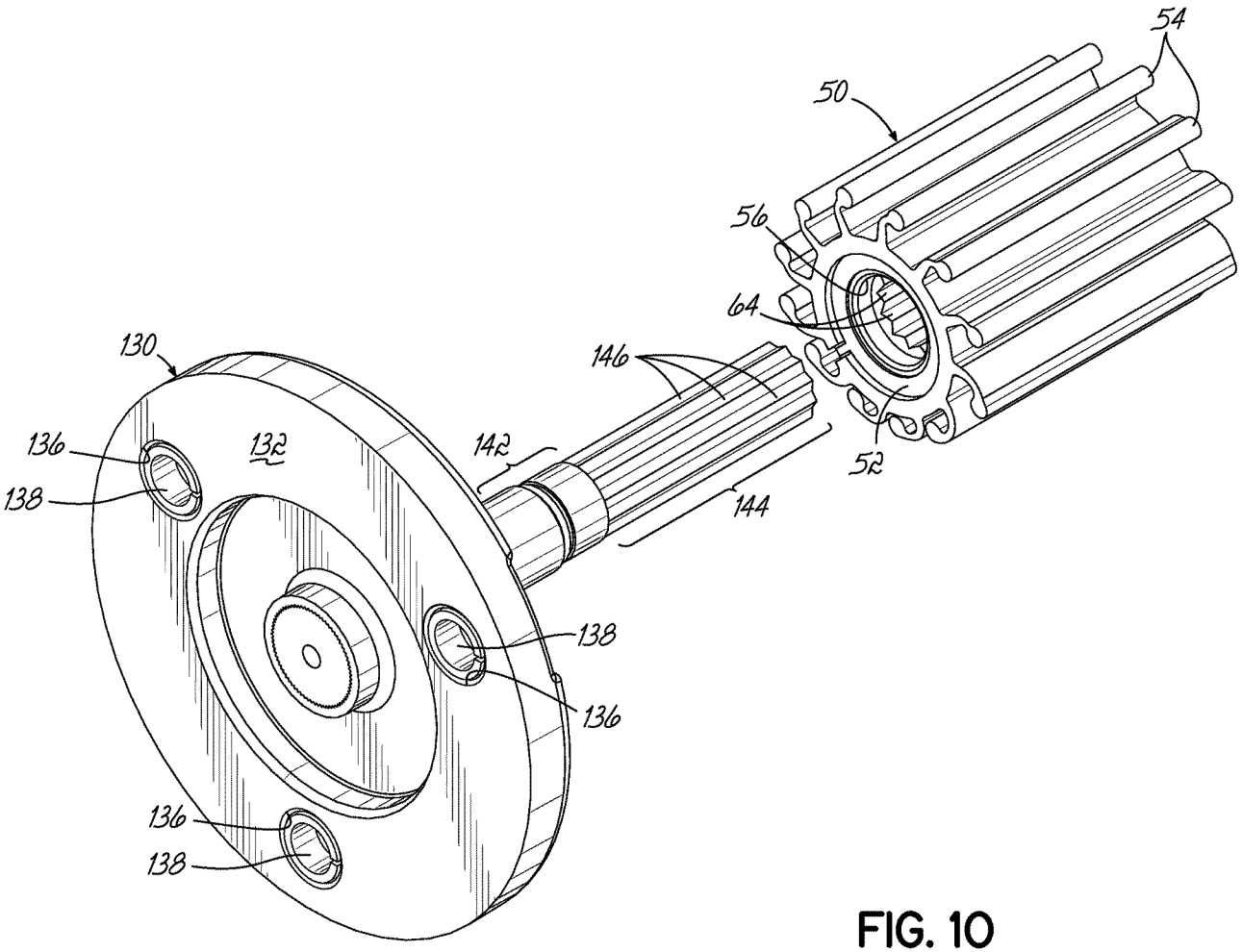
FIG. 10 is a perspective view of the drive assembly and impeller of the water pump showing the interaction between the two components.

As best illustrated in FIGS. 3 and 10, the water pump 10 further comprises a drive assembly 130 comprising a drive flange 132 and a drive shaft 134 extending outwardly from the drive flange 132. As best shown in FIGS. 3 and 6, the drive flange 132 has three holes 136 extending through the drive flange 132. As best illustrated in FIG. 7, a bushing 138 is located inside each of the holes 134. As best illustrated in FIG. 2A, fasteners 140 (only one being shown) extend through the holes 136 in the drive flange 132 and secure the drive assembly 130 to the crank shaft of a marine engine. Alternatively, as shown in FIG. 2B, a drive belt of a marine engine may rotate the drive flange 132 of the drive assembly 130. Although one configuration of drive flange is illustrated, the drive flange may have any number of holes and/or be any configuration other than those illustrated.

As best illustrated in FIG. 10, the drive shaft 134 of the drive assembly 130 has a smooth portion 142 and a splined portion 144. The splined portion 144 of the drive shaft 134 has a plurality of longitudinally extending ribs 146 adapted to engage with the internal ribs 64 of the splined portion 60 of the bore 56 of impeller 50 such that rotation of the drive assembly 130, regardless of how driven, rotates the impeller 50 to move water through the water pump 10.

As best illustrated in FIG. 7, the water pump 10 further comprises two bearings 148 which fit inside a sleeve 150 inside the housing 26. The bearings 148 facilitate rotation of the drive shaft 134 of the drive assembly 130.

Figure 8B:
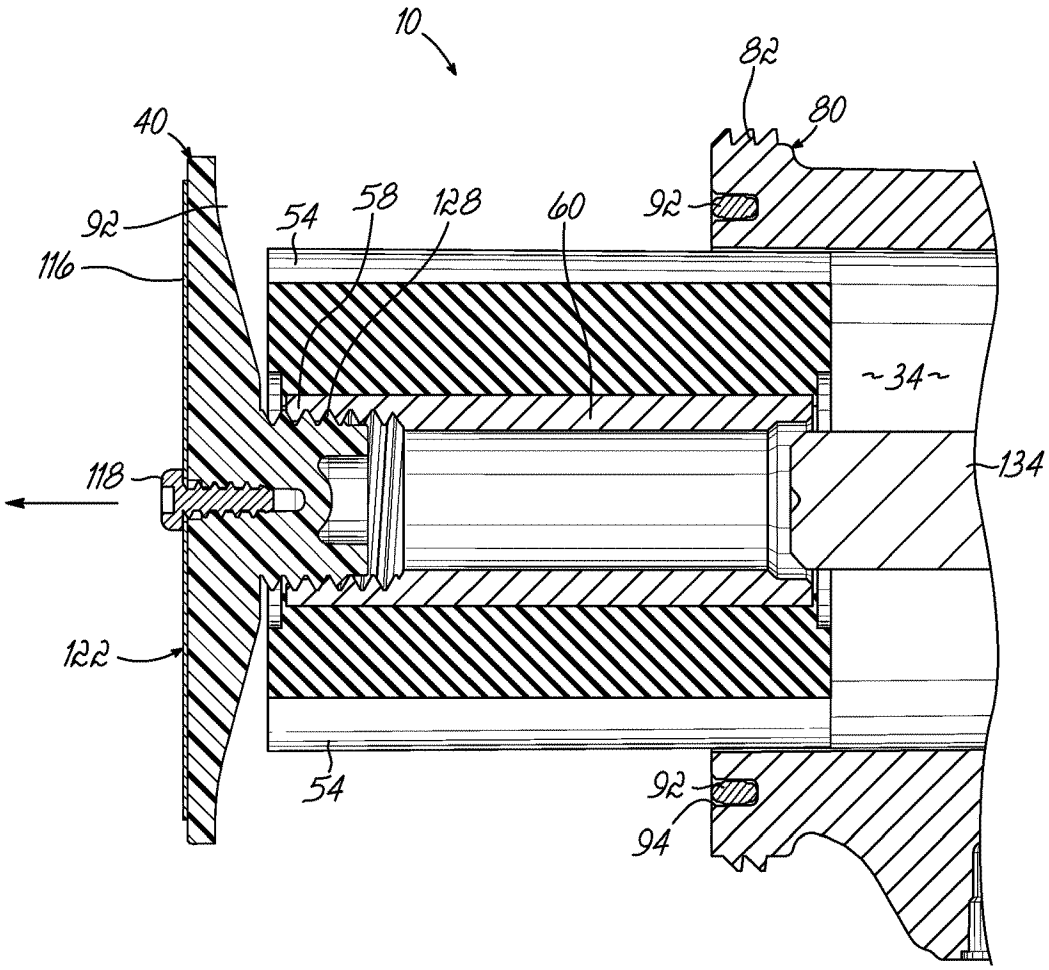
FIG. 8B is a cross-sectional view of the cap of the water pump shown being used as a tool to remove the impeller from inside the water pump housing.
Figure 8A:
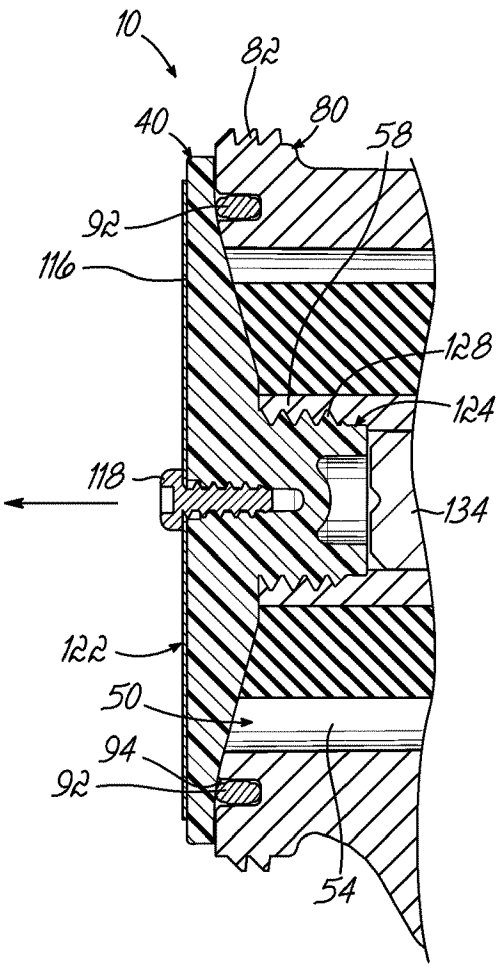
FIG. 8A is a cross-sectional view of the cap of the water pump shown covering the open end of the housing.

FIG. 8A illustrates the cap 40 turned such that the threaded hub 124 of cap 40 is screwed into the threaded portion 58 of the bore 56 of the impeller 50. FIG. 8B illustrates the cap 40 and attached impeller 50 being pulled out of the internal cavity 34 of the housing 26.

Figure 9:
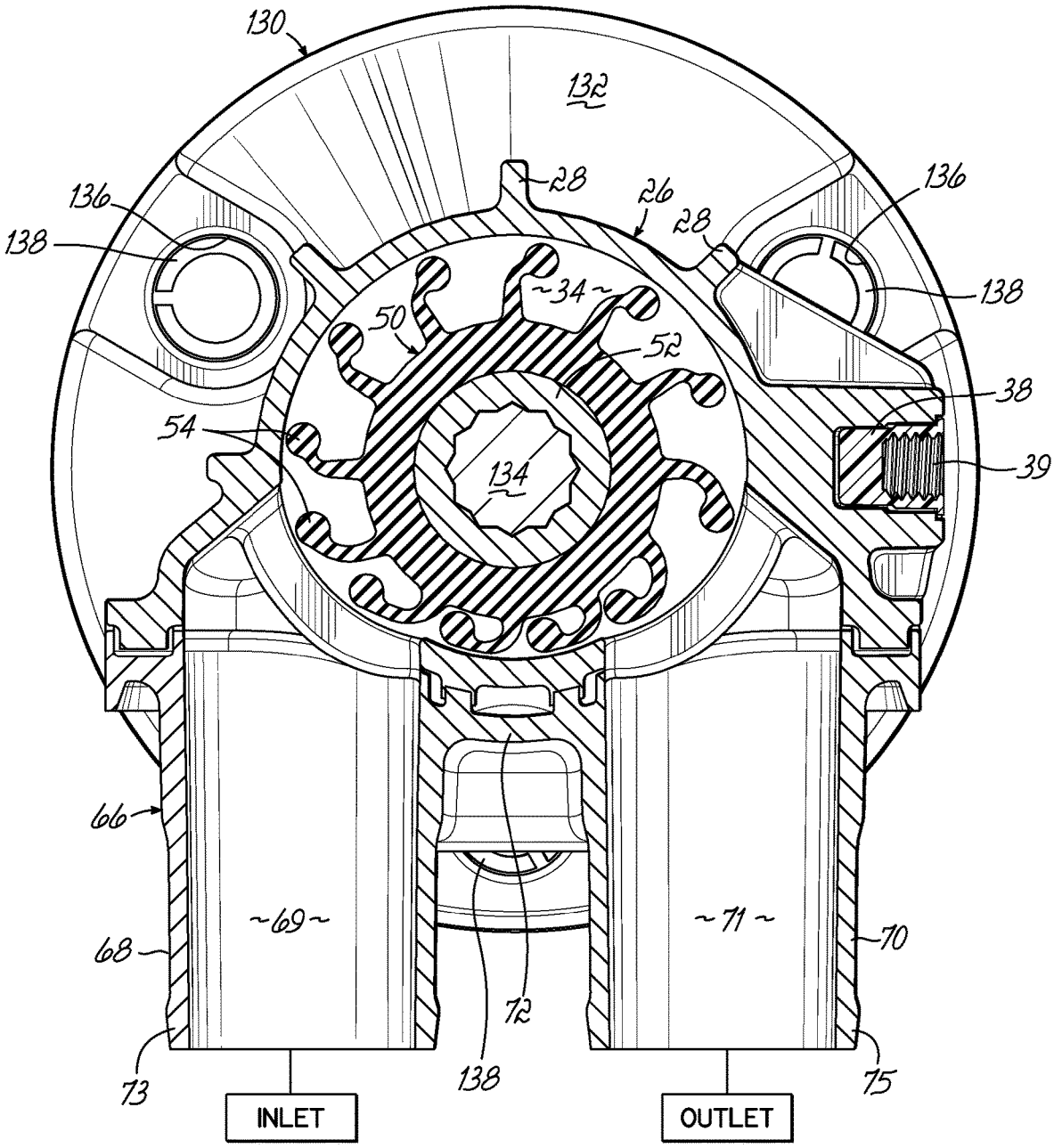
FIG. 9 is a cross-sectional view of the water pump taken along the line 9-9 of FIG. 3 showing the impeller's configuration in use.

As shown in FIG. 9, the internal cavity 34 of the housing 26 has a kidney-shaped cross-section so that the blades 54 of impeller 50 are bent more in some locations than other locations. Therefore, the blades 54 of impeller 50 continue to change shape as the water pump operates.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A water pump for a marine engine, the water pump comprising:

a housing having an internal cavity having an open end and external threads;

an impeller inside the internal cavity of the housing, the impeller having a plurality of flexible blades extending radially outwardly from a central portion, a bore extending through the central portion of the impeller, the bore having a splined portion and a threaded portion;

a drive assembly comprising a drive flange adapted to be rotated by the marine engine and a drive shaft having splines, the drive shaft extending inside the internal cavity of the housing, wherein the splined portion of the impeller bore mates with the splines of the drive shaft such that rotation of the drive shaft rotates the impeller;

a cap lock ring having internal threads along a continuous sidewall and a flange defining a central opening, the internal threads of the cap lock ring engaging the external threads of the housing to secure the cap lock ring to the housing; and a cap having a threaded hub adapted to engage the threaded portion of the bore of the impeller to assist in removing the impeller from the housing, the cap being sized to fit inside the cap lock ring and close the open end of the internal cavity, the threaded hub extending through the central opening of the cap lock ring, wherein the cap lock ring is disengaged from the housing and the cap removed to expose the impeller and enable a person to use the threaded hub of the cap to remove the impeller from inside the internal cavity of the housing.

2. The water pump of claim 1, further comprising a nipple assembly secured to the housing, the nipple assembly comprising first and second nipples, the first nipple being adapted to couple to an inlet hose and the second nipple being adapted to couple to an outlet hose.

3. The water pump of claim 1, wherein the housing has a mounting portion for mounting the housing to the marine engine.

4. The water pump of claim 1, further comprising a wear plate secured to the cap.

5. The water pump of claim 1, wherein the cap has a serrated perimeter to facilitate grasping and rotating the cap.

6. The water pump of claim 1, further comprising bearings inside the housing to facilitate rotation of the drive shaft.

7. The water pump of claim 1, wherein the cap lock ring has integral tabs to facilitate rotating the cap lock ring.

8. A water pump for a marine engine, the water pump comprising:

a housing having an internal cavity and external threads on an open end of the internal cavity;

an impeller inside the internal cavity of the housing, the impeller having a plurality of flexible blades extending radially outwardly from a central portion, a bore extending through the central portion of the impeller, the bore having a splined portion and a threaded portion;

a rotatable drive comprising a drive flange and a drive shaft having splines, the drive shaft extending inside the internal cavity of the housing, wherein the splined portion of the bore of the impeller mates with the splines of the drive shaft such that rotation of the drive shaft rotates the impeller;

a cap lock ring having internal threads and a central opening, the internal threads of the cap lock ring adapted to engage the external threads on the open end of the internal cavity of the housing; and a cap having a threaded hub adapted to engage the threaded portion of the bore of the impeller to remove the impeller, the cap being sized to fit inside the cap lock ring and cover the open end of the internal cavity, the threaded hub extending through the central opening of the cap lock ring, wherein the cap lock ring and the cap are removable to expose the impeller and the threaded hub of the cap used to remove the impeller.

9. The water pump of claim 8, further comprising first and second nipples, the first nipple being sized to couple to an inlet hose and the second nipple being sized to couple to an outlet hose.

10. The water pump of claim 8, wherein the housing has a mounting portion for mounting the housing to the marine engine.

11. The water pump of claim 8, further comprising a metal wear plate secured to the cap.

12. The water pump of claim 8, wherein the cap has a serrated perimeter to facilitate grasping and rotating the cap.

13. The water pump of claim 8, further comprising bearings inside the housing to facilitate rotation of the drive shaft.

14. The water pump of claim 8, wherein the cap lock ring is a unitary member having tabs to facilitate rotating the cap lock ring.

15. A water pump for a marine engine, the water pump comprising:

an injection molded plastic housing having an internal cavity having an open end, the housing having external threads around the open end of the internal cavity;

an impeller inside the internal cavity of the housing, the impeller having a plurality of flexible blades extending radially outwardly from a central portion, a bore extending through the central portion of the impeller, the bore having a splined portion and a threaded portion;

a drive assembly for rotating the impeller, the drive assembly comprising a drive flange and a drive shaft having splines, the drive shaft extending into the internal cavity of the housing, wherein the splined portion of the bore of the impeller mates with the splines of the drive shaft such that rotation of the drive shaft rotates the impeller;

an injection molded plastic cap lock ring having a sidewall, a flange defining a central opening and tabs to facilitate rotating the cap lock ring, the sidewall having internal threads adapted to engage the external threads around the open end of the internal cavity of the housing; and a cap having a threaded hub adapted to engage the threaded portion of the bore of the impeller to remove the impeller, the cap being sized to fit inside the cap lock ring and cover the open end of the internal cavity, the threaded hub extending through the central opening of the cap lock ring and away from the drive assembly, wherein the cap lock ring and the cap are removable without tools to expose the impeller and the threaded hub of the cap screwed into the threaded portion of the bore of the impeller for use removing the impeller.

16. The water pump of claim 15, wherein the housing comprises two mounting bosses for mounting the housing to the marine engine.

17. The water pump of claim 15, further comprising a nipple assembly mounted to the housing, the nipple assembly comprising first and second nipples secured to the housing, the first nipple being sized to couple to an inlet hose and the Second nipple being sized to couple to an outlet hose.

18. The water pump of claim 15, further comprising a metal wear plate secured to the cap.

19. The water pump of claim 15, wherein the cap has a serrated perimeter to facilitate grasping and rotating the cap.

20. The water pump of claim 15, further comprising bearings inside the housing to facilitate rotation of the drive shaft.

* * * * *